US009797360B2

(12) United States Patent
Ke et al.

(10) Patent No.: US 9,797,360 B2
(45) Date of Patent: Oct. 24, 2017

(54) STARTER AND MOWER USING THE STARTER

(71) Applicant: Johnson Electric S.A., Murten (CH)

(72) Inventors: Jun Ke, Shenzhen (CN); Po Wah Chan, Hong Kong (CN); Jun Jie Chu, Hong Kong (CN)

(73) Assignee: Johnson Electric S.A., Murten (CH)

( * ) Notice: Subject to any disclaimer, the term of this patent is extended or adjusted under 35 U.S.C. 154(b) by 662 days.

(21) Appl. No.: 13/714,958

(22) Filed: Dec. 14, 2012

(65) Prior Publication Data

US 2013/0152733 A1 Jun. 20, 2013

(30) Foreign Application Priority Data

Dec. 15, 2011 (CN) ..... 2011 1 0421416

(51) Int. Cl.

| | |
|---|---|
| ***F02N 11/00*** | (2006.01) |
| ***F02N 11/14*** | (2006.01) |
| ***F02N 15/00*** | (2006.01) |
| ***F02N 15/02*** | (2006.01) |
| ***F02N 15/04*** | (2006.01) |

(52) U.S. Cl.

CPC ..... *F02N 11/00* (2013.01); *F02N 11/14* (2013.01); *F02N 15/006* (2013.01); *F02N 15/025* (2013.01); *F02N 15/043* (2013.01); *Y10T 74/134* (2015.01)

(58) Field of Classification Search

CPC ..... F02N 11/00; F02N 15/006; F02N 15/043; F02N 11/14; F02N 15/025

See application file for complete search history.

(56) References Cited

U.S. PATENT DOCUMENTS

| | | | | |
|---|---|---|---|---|
| 3,395,687 | A * | 8/1968 | Harkness | 123/185.14 |
| 3,500,085 | A * | 3/1970 | Smith | F02N 15/006 123/179.26 |
| 4,155,266 | A * | 5/1979 | Bradley | F02N 15/006 123/179.25 |
| 4,506,162 | A * | 3/1985 | Bolenz et al. | 290/38 A |
| 4,507,566 | A * | 3/1985 | Leatherman | A01D 34/6806 123/179.25 |
| 4,777,836 | A * | 10/1988 | Giometti | 74/6 |
| 4,909,218 | A * | 3/1990 | Uuskallio | 123/400 |
| 5,095,865 | A * | 3/1992 | Keister | 123/179.5 |
| 5,596,902 | A * | 1/1997 | McMillen | F02N 15/063 464/46 |
| 5,751,070 | A * | 5/1998 | Nagao et al. | 290/46 |
| 5,943,909 | A * | 8/1999 | Soh | 74/6 |
| 6,230,678 | B1 * | 5/2001 | Gracyalny et al. | 123/185.14 |
| 7,647,849 | B2 * | 1/2010 | Miyake | 74/7 E |

(Continued)

*Primary Examiner* — David M Fenstermacher

(74) *Attorney, Agent, or Firm* — Muncy, Geissler, Olds & Lowe, P.C.

(57) ABSTRACT

A starter has a high voltage direct current electric motor, a speed reduction device, a clutch, an output gear and a switch box configured to turn on the electric motor. The output gear is driven by the electric motor via the speed reduction device and the clutch. The starter also has a stationary axle on which the output gear is installed. The electric motor has an output shaft. The speed reduction device has a drive gear fixed to the output shaft and a driven gear meshed with the drive gear, the driven gear being rotatably mounted to the axle via a bushing.

20 Claims, 6 Drawing Sheets

(56) References Cited

U.S. PATENT DOCUMENTS

| | | | | |
|---|---|---|---|---|
| 7,886,706 | B2 * | 2/2011 | Grybush | B60R 25/04 123/179.24 |
| 2002/0069711 | A1 * | 6/2002 | Hosoya | 74/6 |
| 2006/0219032 | A1 * | 10/2006 | Miyake | 74/7 E |
| 2007/0181100 | A1 * | 8/2007 | Grybush et al. | 123/400 |
| 2008/0203973 | A1 * | 8/2008 | Gale | B60L 11/1816 320/157 |

* cited by examiner

STARTER AND MOWER USING THE STARTER

CROSS REFERENCE TO RELATED APPLICATIONS

This non-provisional patent application claims priorities under 35 U.S.C. §119(a) from Patent Application No. 201110421416.7 filed in The People's Republic of China on Dec. 15, 2011.

FIELD OF THE INVENTION

This invention relates to an electric starter for an internal combustion engine and in particular, to a starter using a direct current motor and to a mower incorporating the starter.

BACKGROUND OF THE INVENTION

Lawnmowers are widely used to cut grass. However, the traditional lawnmower starting system uses a low voltage direct current (DC) motor with a lot of accessories such as a battery, an alternator to charge the battery, a relay and so on. Thus the structure of the traditional lawnmower starting system is complicated.

Hence there is a desire to provide a simple lawnmower starting system.

SUMMARY OF THE INVENTION

Accordingly, in one aspect thereof, the present invention provides a 1. A starter for an internal combustion engine, comprising: a high voltage direct current electric motor, a speed reduction device, a clutch, an output gear and a switch box configured to turn on or off the electric motor, the output gear being driven by the electric motor via the speed reduction device and clutch.

Preferably, the starter further comprises a stationary axle on which the output gear is installed.

Preferably, the electric motor comprises an output shaft, the speed reduction device comprises a drive gear fixed to the output shaft and a driven gear meshed with the drive gear, the driven gear being rotatably mounted to the axle via a bushing.

Preferably, the starter further comprising a metal mounting plate disposed between the motor and the speed reduction device, one end of the axle being fixed to the mounting plate, wherein the mounting plate defines a plurality of mounting holes for fasteners to fix the starter to the engine.

Preferably, the starter further comprises a mounting bracket which comprises a tube-shaped casing in which the electric motor is located, and a supporting flange radially extending outwardly from the casing, wherein the metal mounting plate is fixed to the supporting flange by fasteners.

Preferably, each of the mounting holes defines an axis which is parallel to an axis of the electric motor.

Alternatively, each of the mounting holes defines an axis which is perpendicular to an axis of the electric motor.

Preferably, the starter further comprises a lid which cooperates with the mounting plate to form an enclosed space, the speed reduction device and clutch being received in the space.

Preferably, the mounting plate is sandwiched between the lid and the supporting flange, and a pair of seals is respectively disposed between opposite sides of the mounting plate and the lid and the supporting flange.

Preferably, the starter further comprises a protective cap configured for partly covering the output gear, wherein the cap defines an opening at one side thereof for providing access for the output gear to engage with a flywheel of the engine.

Preferably, the protective cap comprises a radially extended mounting flange which defines elongated slots, fasteners respectively extending through the elongated slots, the lid, the mounting plate and the supporting flange of the mounting bracket to engage with nuts to thereby fix the protective cap, the lid, the mounting plate and the mounting bracket together.

Preferably, the clutch comprises the driven gear, a drive part, a friction part, a wave-shaped elastic part and a cover, and wherein the drive part, the friction part, and the wave-shaped elastic part are sandwiched between the driven gear and the cover, the wave-shaped elastic part being compressed between the cover and the friction part.

Preferably, a spline is rotatably mounted on the axle and the output gear is moveably mounted on the spline, one axial end of the spline extending into the cover of the clutch to engage with the drive part of the clutch.

Preferably, the switch box comprises a connector configured to electrically connect to a high voltage power source, a cable connecting the switch box to the motor.

In another aspect thereof, the present invention provides a mower incorporating the starter.

Preferably, the mower comprises: a body; a handle extending from the body; a plurality of wheels installed at the bottom of the body; an internal combustion engine installed at the top of the body; and the starter installed on one side of the engine and arranged to selectively engage and rotate a flywheel of the engine to start the engine, the switch box of the starter being installed on the handle.

Additional preferred features of the starter are as described herein.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF VARIOUS EMBODIMENTS

Figure 1:
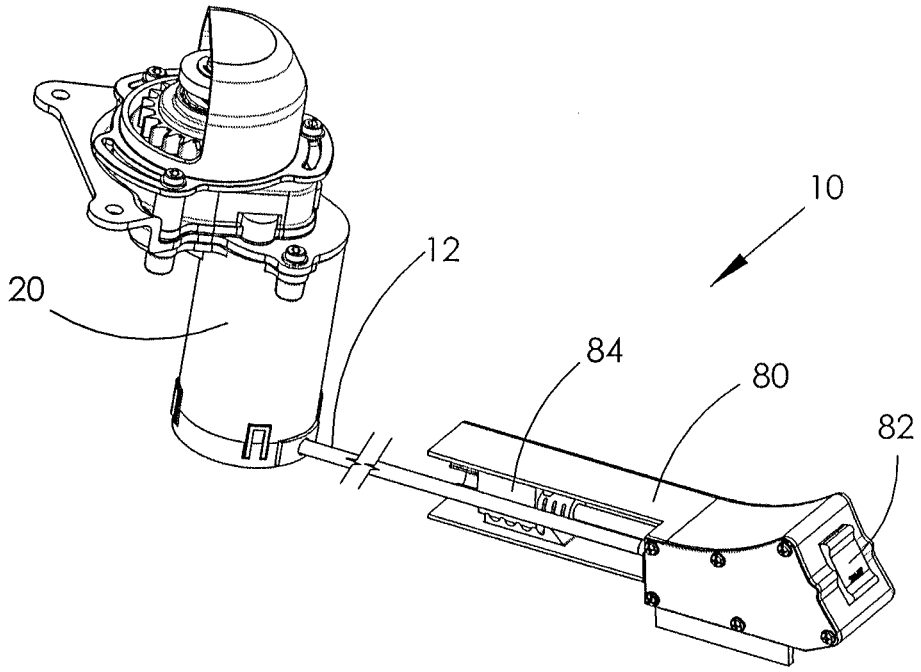
FIG. 1 illustrates a starter in accordance with the preferred embodiment of the present invention.

With reference to the preferred embodiment of the present invention shown in FIGS. 1 to 5, an electrical starter 10 for an internal combustion engine, comprises an electric motor 20, a speed reduce device 30, a clutch 40, a stationary axle 50, an output gear 60 and a switch box 80.

Figure 10:
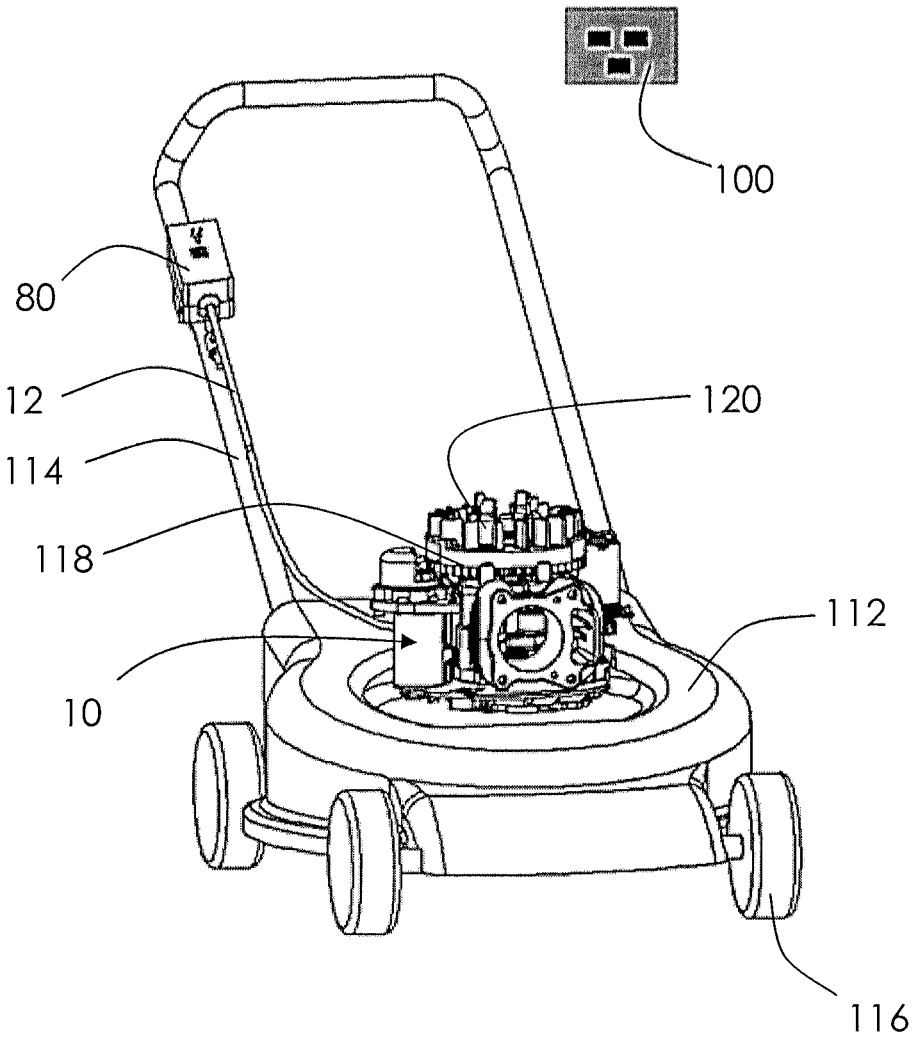
FIG. 10 is a partial view of a lawnmower using the starter of FIG. 1.

Referring to FIG. 1, the motor 20 is electrically connected to the switch box 80 via a cable 12. The switch box 80 comprises a switch 82 configured to turn on or off the motor 20, and a connector 84 configured to be electrically coupled to a power source 100 (FIG. 10). Preferably, the connector 84 is a plug configured to receive a socket formed at one end of a power cable, the other end of which is connected to the power source 100. The switch box 80 comprises a rectifier configured to convert alternating current (AC) voltage to direct current (DC) voltage.

Preferably, the motor 20 is a high voltage direct current motor which is capable of receiving high voltage direct current output from the switch box 80 which is electrically connected to a high voltage power source. High voltage means the voltage of power generally supplied for domestic use. The high voltage power source of the present application means power sources for domestic or normal consumer electricity, usually in the range of 100-500 volts, for example: 100 volts, 110 volts, 120 volts, 220 volts or 240 volts.

Figure 3:
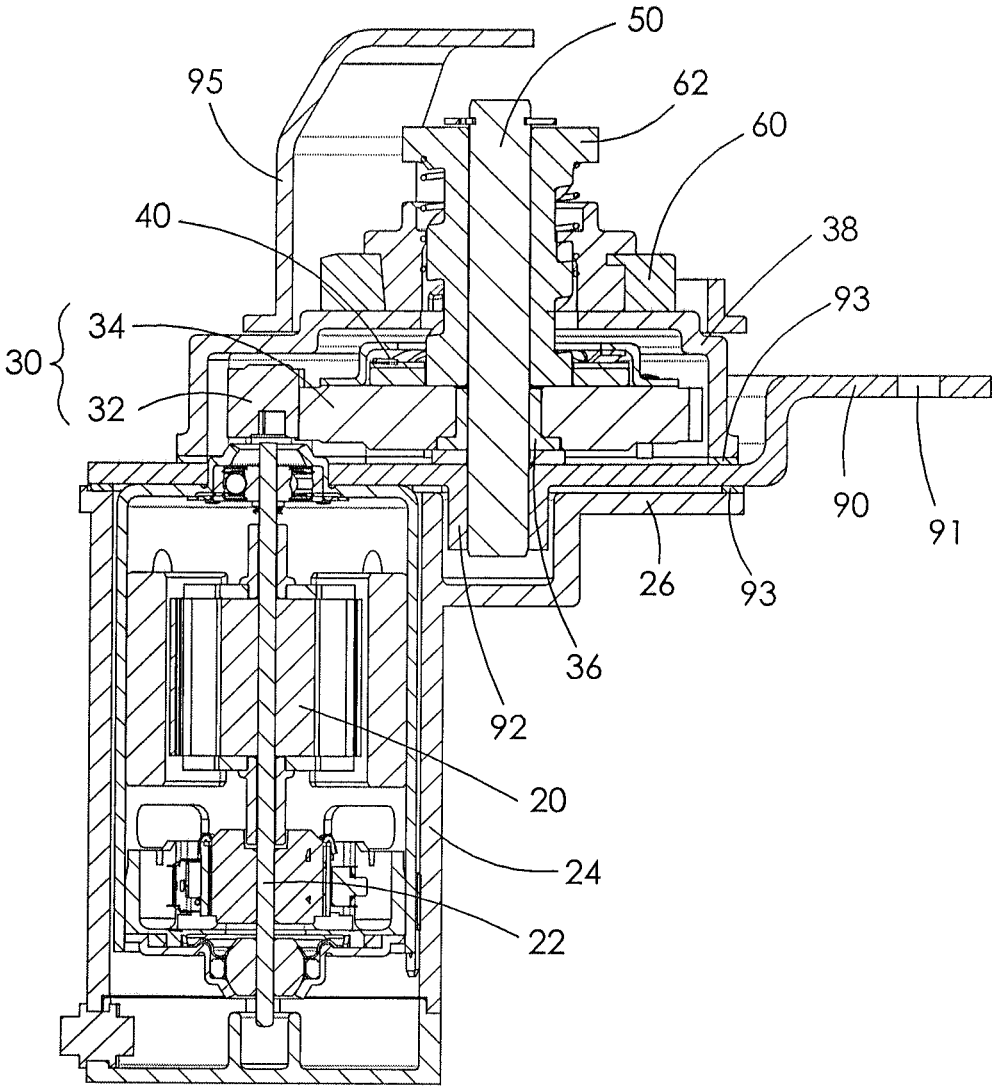
FIG. 3 is a sectional view of the starter of FIG. 1.
Figure 4:
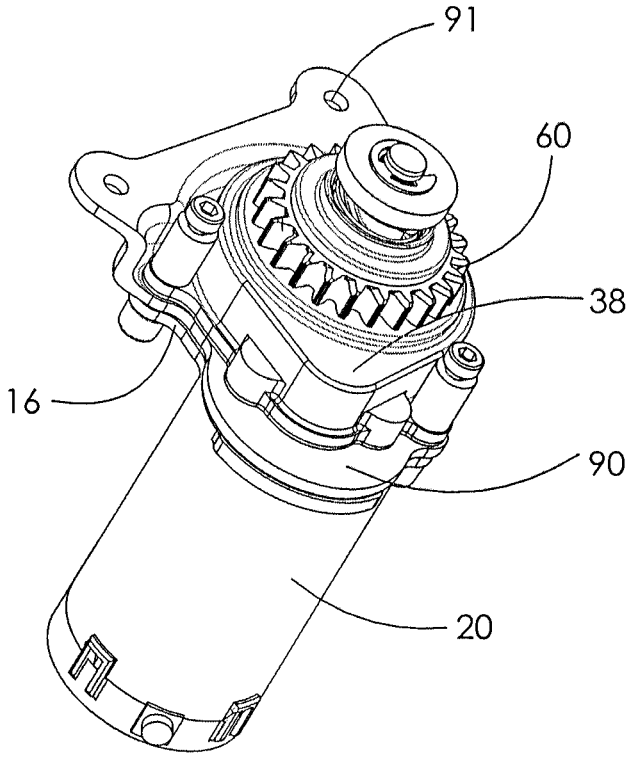
FIG. 4 illustrates the starter of FIG. 1, with a protective cap removed.
Figure 5:
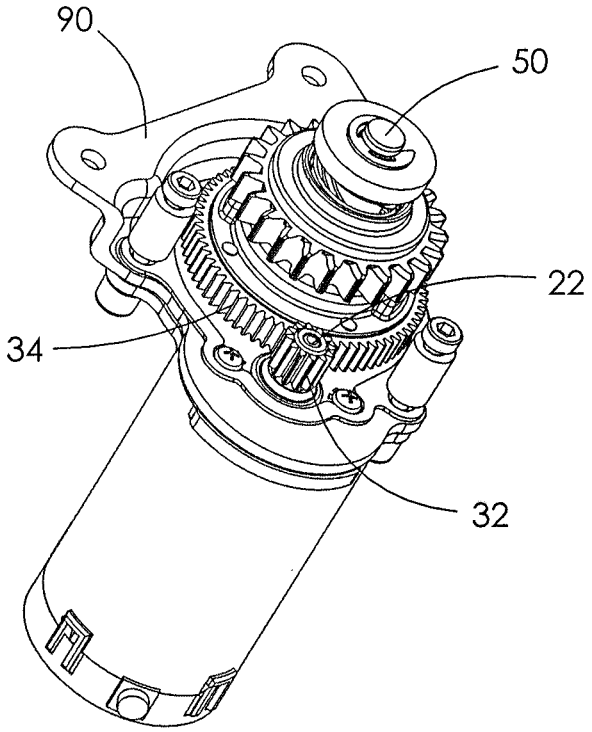
FIG. 5 illustrates the starter of FIG. 1, with the protective cap and a lid removed.

Referring to FIG. 3, the motor 20 has an output shaft 22. The speed reduction device 30 comprises a drive gear 32 fixed to the output shaft 22 of the motor 20, and a driven gear 34 rotatably attached to the stationary axle 50 and meshed with the drive gear 32. The drive gear 32 and driven gear 34 are made of metal. The axle 50 is made of metal and is arranged parallel to the output shaft 22 of the motor 20. One end of the axle 50 is fixed to a mounting plate 90. A bushing 36 is disposed between the driven gear 34 and the axle 50 such that the driven gear 34 is rotatably mounted about the axle 50 without directly contacting the outer surface of the axle 50. As such, a direct metal to metal friction or rubbing contact is avoided and noise is therefore reduced.

Figure 6:
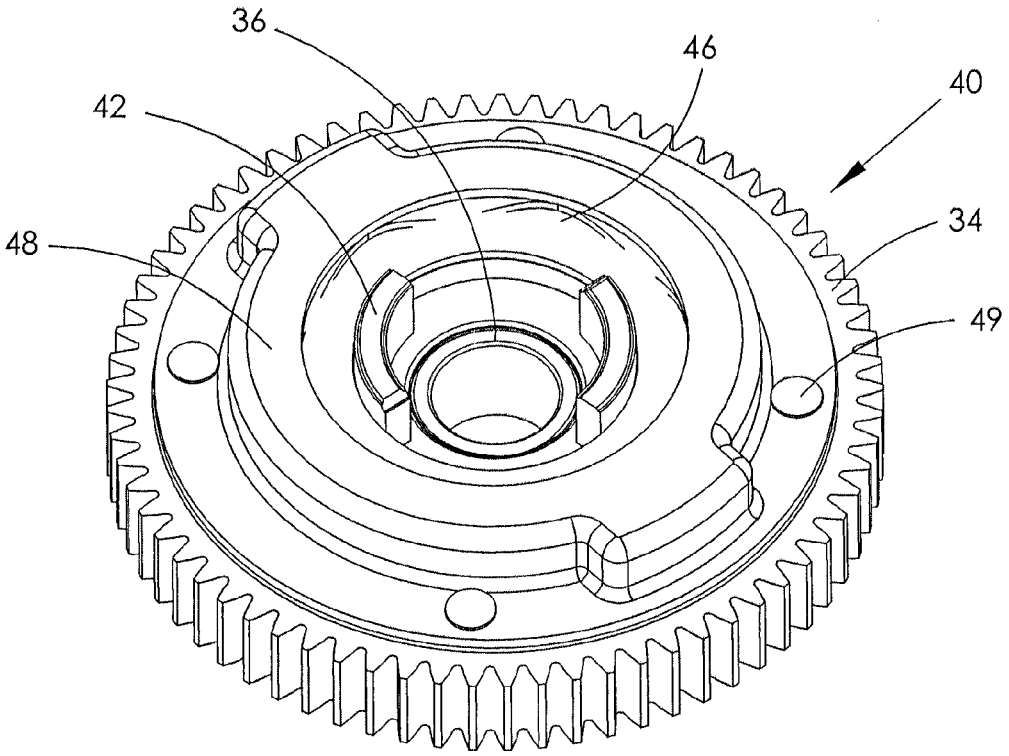
FIG. 6 illustrates a clutch of the starter of FIG. 1.
Figure 7:
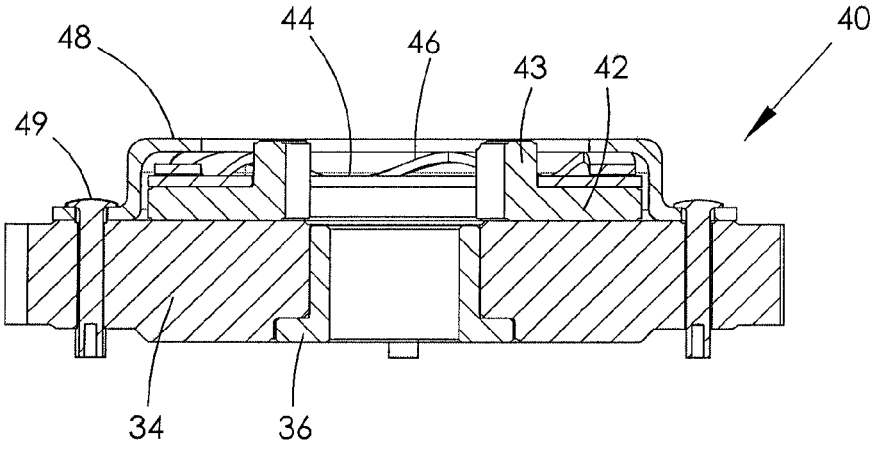
FIG. 7 is a sectional view of the clutch of FIG. 6.
Figure 8:
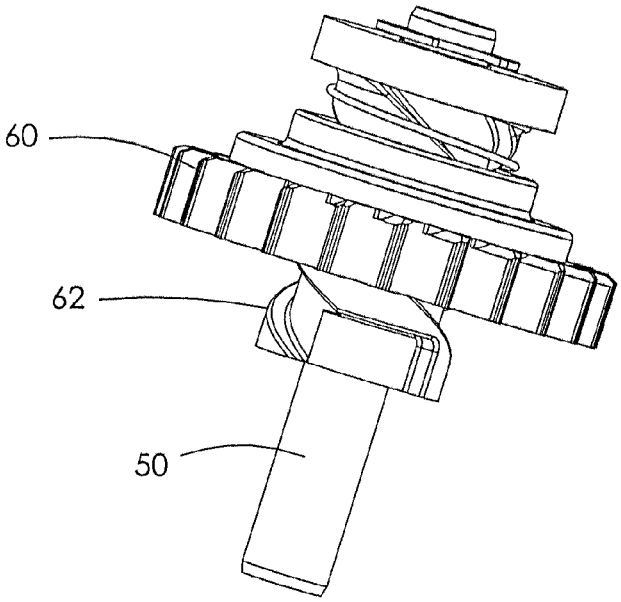
FIG. 8 illustrates an axle, a spline mounted on the axle, and an output gear mounted on the spline of the starter of FIG. 1.

Referring to FIGS. 6 and 8, the clutch 40 comprises the driven gear 34, a drive part 42 with a pair of teeth 43, a friction part 44, a wave-shaped elastic part 46 (also known as a wave washer) and a cover 48. The cover 48 comprises a flange and a recess sunken from the flange. Fasteners 49 extend through the flange of the cover 48 and engage with the driven gear 34 to thereby fix the cover 48 to the driven gear 34. The drive part 42, friction part 44 and elastic part 46 being received in the recess of the cover 48, are sandwiched between the driven gear 34 and the recessed portion of the cover 48 in the axial direction of the driven gear 34. The drive part 42, friction part 44 and cover 48 define coaxial central holes through which the axle 50 extends. The elastic part 46 is compressed between the cover 48 and friction part 44 and is deformed to thereby resiliently urge the friction part 44 to frictionally contact with the drive part 42 which in turn firmly contacts the driven gear 34. As such, the clutch 40 becomes a friction clutch limiting the amount of torque which can be transmitted to the drive part 42 by the driven gear 34.

Referring to FIG. 3, a spline 62 with a pair of threads is mounted on the other end of the axle 50 and one end of the spline 62 is inserted into the central hole of the clutch 40 and engaged with the teeth 43 of the drive part 42. The output gear 60 is mounted on the spline 62.

In operation, when the motor 10 is turned on, the driven gear 34 is rotated by the drive gear 32. The drive part 42, friction part 44, elastic part 46 and cover 48 rotate with the driven gear 34. The spline 62 is driven by the teeth 43 of the drive part 42 to rotate about the axle 50. As a result, the output gear 60 is driven to move along the axial 50 towards a flywheel 120 of an engine 118 (FIG. 10) until it meshes with the flywheel 120, at this point the output gear 60 rotates the flywheel to start the engine 118, in a generally known manner.

Figure 2:
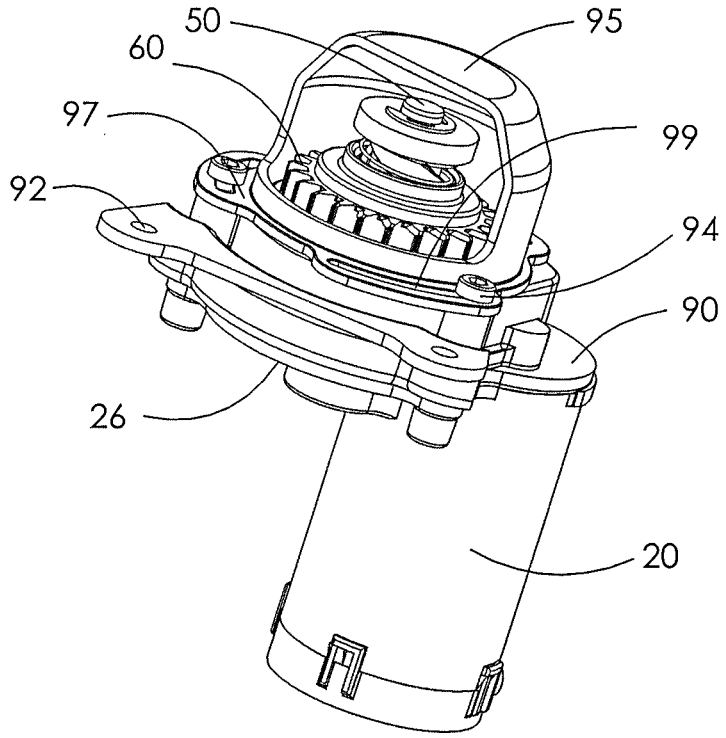
FIG. 2 is an enlarged view of the starter of FIG. 1, viewed from another aspect.

Referring to FIGS. 2 and 3, preferably, a metal mounting plate 90 is disposed between the motor 20 and the speed reduction device 30. The mounting plate 90 defines a plurality of mounting holes 91. Fasteners extend through the mounting holes 91 to engage with the engine 118 to thereby fix the starter to the engine 118. In this embodiment, the axis of the mounting holes 91 is parallel to the axis of the motor 20. The mounting plate 90 forms a hub 92 which protrudes there from in a direction away from the clutch 40. The end of the axle 50 is received in the hub 92 with an interference fit. The mounting plate 90 is preferably formed by stamping a steel plate. The starter further comprises a mounting bracket which comprises a tube-shaped casing 24 in which the electric motor 20 is received, and a supporting flange 26 radially extending outwardly from the casing 24. The metal mounting plate 90 is fixed to the supporting flange 26 by fasteners.

The speed reduction device 30 further comprises a lid 38 which is fixed to the mounting plate 90. The driver gear 32 and the clutch 40 are received in an enclosed space formed between the lid 38 and the mounting plate 90. Thus, dust particles are stopped from entering in the space and lubricating oil of the gears 32, 34 is stopped from leaking out of the space. The lid 38 defines a hole to allow the axle 50 and spline 62 to extend there through. Preferably, a pair of seal rings 93 is respectively disposed between the lid 38/mounting bracket 26 and opposite sides of the mounting plate 90.

Preferably, the starter further comprises a protective cap 95 which partly covers the output gear 60 to prevent users from touching the output gear 60 accidently. The cap 95 defines an opening at one side for providing access for the output gear 60 to engage with the flywheel 120 of the engine 118. The axial end of the cap 95 covers the axial end of the axle 50 with an axial gap formed there between. The cap 95 comprises a flange 97 which defines a plurality of elongated slots 99. Fasteners 94 respectively extend through the slots 99, the lid 38, the mounting plate 90 and the supporting flange 26 of the mounting bracket to engage with nuts, thereby fix them together. Orientation of the opening of the cap 95 is adjustable by adjusting the location of the fasteners 94 in the slots 99.

Figure 9:
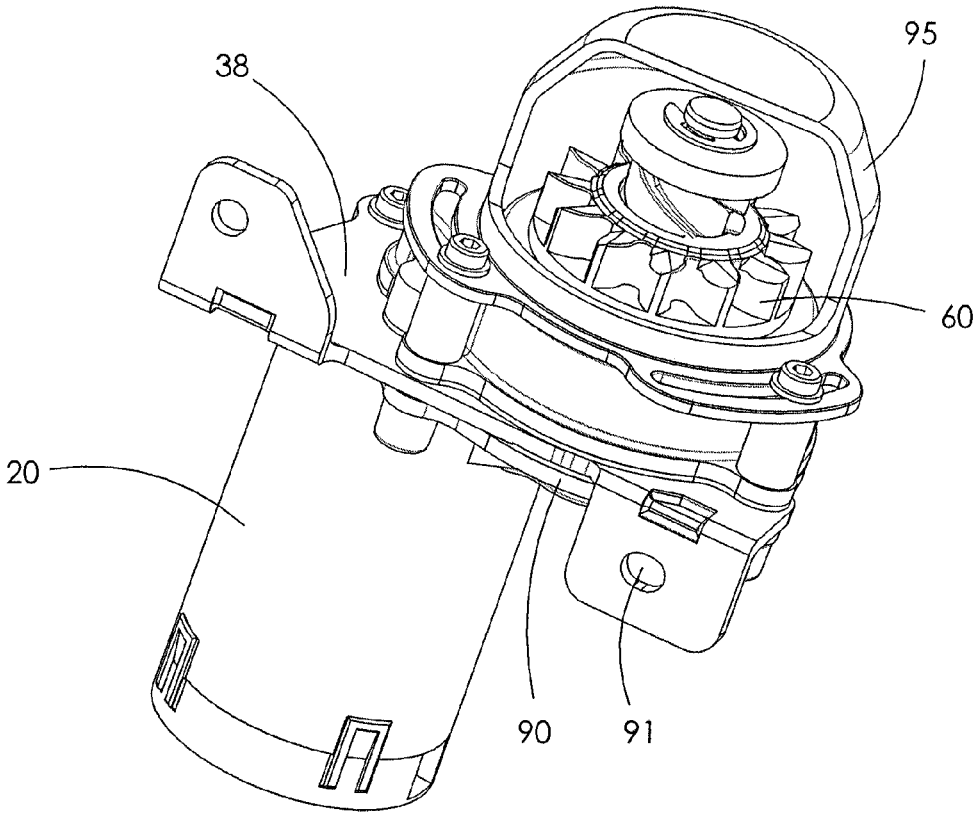
FIG. 9 illustrates a starter in accordance with an alternative embodiment of the present invention.

Referring to FIG. 9, alternatively, the axis of the mounting holes 91 of the mounting plate 90 is perpendicular to the axis of the motor 10. The periphery of the lid 38 conforms to that of the supporting flange 26 of the mounting bracket. The mounting plate 90 is sandwiched between the lid 38 and the supporting flange 26 of the mounting bracket. The mounting plate has two tabs which are bent at right angles to the main body of the mounting plate and the mounting holes are formed in the tabs.

FIG. 10 shows a mower 110 using the starter 10. The mower 110 is a lawnmower of which the engine displacement is less than 235 cc. The mower 110 comprises a body 112, a handle 114, a plurality of wheels 116 installed at the bottom of the body 112, and an engine 118 installed at the top of the body 112. The starter 10 is mounted on one side of the engine 118. The switch box 80 of the starter 10 is installed on the handle 114 so that it is convenient for users to turn on or off the starter 10.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A starter for an internal combustion engine, comprising: a high voltage direct current electric motor, a speed reduction device, a clutch, an output gear, a switch box configured to turn on or off the electric motor and a stationary axle on which the output gear is installed, the stationary axle being stationary in a rotational sense, the output gear being driven by the electric motor via the speed reduction device and clutch to directly drive a flywheel of the internal combustion engine; the high voltage direct current electric motor selectively receiving a high voltage direct current output from the switch box which is electrically connected to a high voltage power source having a voltage in the range of 100-500 volts.

2. The starter of claim 1, wherein the switch box comprises a connector configured to electrically connect to an alternating current high voltage power source, a rectifier converting alternating current to direct current, and a cable connecting the switch box to the motor.

3. The starter of claim 1, wherein the electric motor comprises an output shaft, the speed reduction device comprises a drive gear fixed to the output shaft and a driven gear meshed with the drive gear, the driven gear being rotatably mounted to the stationary axle via a bushing.

4. The starter of claim 3, wherein the clutch comprises the driven gear, a drive part, a friction part, a wave-shaped elastic part and a cover, and wherein the drive part, the friction part, and the wave-shaped elastic part are sandwiched between the driven gear and the cover, the wave-shaped elastic part being compressed between the cover and the friction part.

5. The starter of claim 4, wherein a spline is rotatably mounted on the stationary axle and the output gear is moveably mounted on the spline, one axial end of the spline extending into the cover of the clutch to engage with the drive part of the clutch.

6. The starter of claim 1, further comprising a metal mounting plate disposed between the motor and the speed reduction device, one end of the stationary axle being fixed to the mounting plate, wherein the mounting plate defines a plurality of mounting holes for fasteners to fix the starter to the engine.

7. The starter of claim 6, wherein each of the mounting holes defines an axis which is one of parallel and perpendicular to an axis of the electric motor.

8. The starter of claim 6, further comprising a protective cap configured for partly covering the output gear, wherein the cap defines an opening at one side thereof for providing access for the output gear to engage with a flywheel of the engine.

9. The starter of claim 6, further comprising a mounting bracket which comprises a tube-shaped casing in which the electric motor is located, and a supporting flange radially extending outwardly from the casing, wherein the metal mounting plate is fixed to the supporting flange by fasteners.

10. The starter of claim 9, wherein the starter further comprises a lid which cooperates with the mounting plate to form an enclosed space, the speed reduction device and clutch being received in the space.

11. The starter of claim 10, wherein a protective cap comprises a radially extended mounting flange which defines elongated slots, fasteners respectively extending through the elongated slots, the lid, the mounting plate and the supporting flange of the mounting bracket to engage with nuts to thereby fix the protective cap, the lid, the mounting plate and the mounting bracket together.

12. The starter of claim 10, wherein the mounting plate is sandwiched between the lid and the supporting flange, and a pair of seals is respectively disposed between opposite sides of the mounting plate and the lid and the supporting flange.

13. A mower comprising a body, a handle extending from the body, a plurality of wheels installed at the bottom of the body, an internal combustion engine installed at the top of the body, and a starter installed on one side of the engine and arranged to selectively engage and rotate a flywheel of the engine to start the engine, wherein the starter comprises a high voltage direct current electric motor, a speed reduction device, a clutch, an output gear, a switch box configured to turn on or off the electric motor, and a stationary axle on which the output gear is installed, the stationary axle being stationary in a rotational sense, the output gear being driven by the electric motor via the speed reduction device and clutch to directly drive the flywheel, the switch box being installed on the handle.

14. The mower of claim 13, wherein a spline is rotatably mounted on a stationary axle and the output gear is moveably mounted on the spline, one axial end of the spline extending into the cover of the clutch to engage with the drive part of the clutch.

15. The mower of claim 13, wherein the electric motor comprises an output shaft, the speed reduction device comprises a drive gear fixed to the output shaft and a driven gear meshed with the drive gear, the driven gear is rotatably mounted to the stationary axle via a bushing.

16. The mower of claim 15, further comprising a metal mounting plate disposed between the motor and the speed reduction device, one end of a stationary axle being fixed to the mounting plate, wherein the mounting plate defines a plurality of mounting holes for fixing the starter to the engine.

17. The mower of claim 16, further comprising a mounting bracket which comprises a tube-shaped casing in which the electric motor is located, and a supporting flange radially extending outwardly from the casing, wherein the metal mounting plate is fixed to the supporting flange by fasteners.

18. The mower of claim 17, wherein the starter further comprises a lid which cooperates with the mounting plate to form an enclosed space, the speed reduction device and clutch being received in the space.

19. The mower of claim 15, wherein the clutch comprises the driven gear, a drive part, a friction part, a wave-shaped elastic part and a cover, and wherein the drive part, the friction part, and the wave-shaped elastic part are sandwiched between the driven gear and the cover, the wave-shaped elastic part being compressed between the cover and the friction part.

20. A starter for an internal combustion engine, comprising: a high voltage direct current electric motor, a speed reduction device, a clutch, an output gear, a switch box configured to turn on or off the electric motor, and a stationary axle independent of an output shaft of the motor, the output gear being driven by the electric motor via the speed reduction device and clutch, the high voltage direct current electric motor selectively receiving a high voltage direct current output from the switch box which is electrically connected to a high voltage power source having a voltage in the range of 100-500 volts.

* * * * *